US005628156A

United States Patent [19]

Tarics

[11] Patent Number: 5,628,156

[45] Date of Patent: May 13, 1997

[54] MOMENT RESISTING FRAME HAVING CRUCIFORM COLUMNS AND BEAM CONNECTIONS AND METHOD FOR USE THEREWITH

[76] Inventor: Alexander G. Tarics, 29 Windward Rd., Belvedere, Calif. 94920

[21] Appl. No.: 547,256

[22] Filed: Oct. 24, 1995

[51] Int. Cl.[6] ..... E04B 1/38

[52] U.S. Cl. ..... 52/236.3; 52/167.3; 52/283; 52/656.1

[58] Field of Search ..... 52/653.1, 650.3, 52/729.1, 736.2, 737.2, 737.6, 167.3, 283, 289, 236.3, 236.6, 236.9, 656.1, 656.9

[56] References Cited

U.S. PATENT DOCUMENTS

| | | | |
|---|---|---|---|
| 1,594,658 | 8/1926 | Bushong | 52/729.1 X |
| 2,084,649 | 6/1937 | MacMillan | 52/650.3 |
| 3,295,288 | 1/1967 | Bakke et al. | 52/737.2 X |
| 3,672,711 | 6/1972 | Red | 52/283 X |
| 5,174,080 | 12/1992 | Yoshimura et al. | 52/252 |

*Primary Examiner*—Michael Safavi

*Attorney, Agent, or Firm*—Flehr Hohbcah Test Albritton & Herbert LLP

[57] ABSTRACT

A moment resisting frame comprising a vertical column having a cruciform shape in cross section and having first and second vertically extending surfaces extending at an angle and being disposed at an angle with respect to each other and extending along X and Y axes and defining a space therebetween. Upper and lower spaced apart horizontally disposed gusset plates are secured to the first and second surfaces. A beam having first and second ends and a longitudinal axis is provided. The beam has upper and lower flanges and a vertically extending web extending between the flanges. The first end of the beam extends into a position adjacent the space and in a direction which is disposed between X and Y axes. A connection is disposed in the space for securing the first end of the beam to the surfaces and to the upper and lower gussets.

10 Claims, 1 Drawing Sheet

MOMENT RESISTING FRAME HAVING CRUCIFORM COLUMNS AND BEAM CONNECTIONS AND METHOD FOR USE THEREWITH

In general, it is an object of the present invention to provide a moment resisting frame having cruciform columns and beam connections and a method for use therewith to provide improved earthquake resistance.

Moment resisting steel frames have often been utilized in highrise buildings. Typically such moment resistant frames have utilized butt-welded steel column to steel beam connections. The butt welds have been made where the flange of the steel column and the flanges of the steel beam meet. Such butt welding has been accomplished in the field during erection of the steel frame for the structure being erected. In recent earthquakes and particularly in the Northridge earthquake in California, such moment frame buildings have encountered failures in the butt welds which will require expensive repair to prevent the collapse of such moment frame buildings in future earthquakes. There is therefore a need for new and improved beam connections for such moment frame buildings to be constructed in the future.

In general, it is an object of the present invention to provide a moment resisting frame having cruciform columns with beam connections and a method of fabrication which provides improved earthquake resistance.

Another object of the invention is to provide a frame and beam connection of the above character which eliminates butt welding and only uses fillet welding and/or high strength bolts, Another object of the invention is to provide a frame beam connection and method of the above character which does not permit relative movement between connected parts.

Another object of the invention is to provide a frame and beam connection and method of the above character which is particularly suitable for use with frames having cruciform columns.

Another object of the invention is to provide a frame and beam connection and method of the above character in which the cruciform columns are rotated by approximately 45° from the conventional systems utilized in moment frame construction to facilitate making the improved beam connections.

Additional objects and features of the invention will appear from the following description in which the preferred embodiments are set forth in detail in conjunction with the accompanying drawings.

In general, the moment resisting frame of the present invention is comprised of a vertical column having a cruciform shape in cross section and having first and second vertically extending surfaces extending at an angle with respect to each other and being disposed on X and Y axes and defining a space therebetween. Upper and lower spaced apart horizontally disposed gusset plates are secured to the first and second surfaces and extend into said space. A beam is provided having first and second ends and having a longitudinal axis. The beam has upper and lower flanges and a vertically extending web extending between the flanges. The first end of the beam extends into the space between said first and second vertically extending surfaces so that the longitudinal axis of the beam extends at an angle between said X and Y axis. Means is provided for securing the first end of the beam to said first and second surfaces and said upper and lower gussets.

Figure 2:
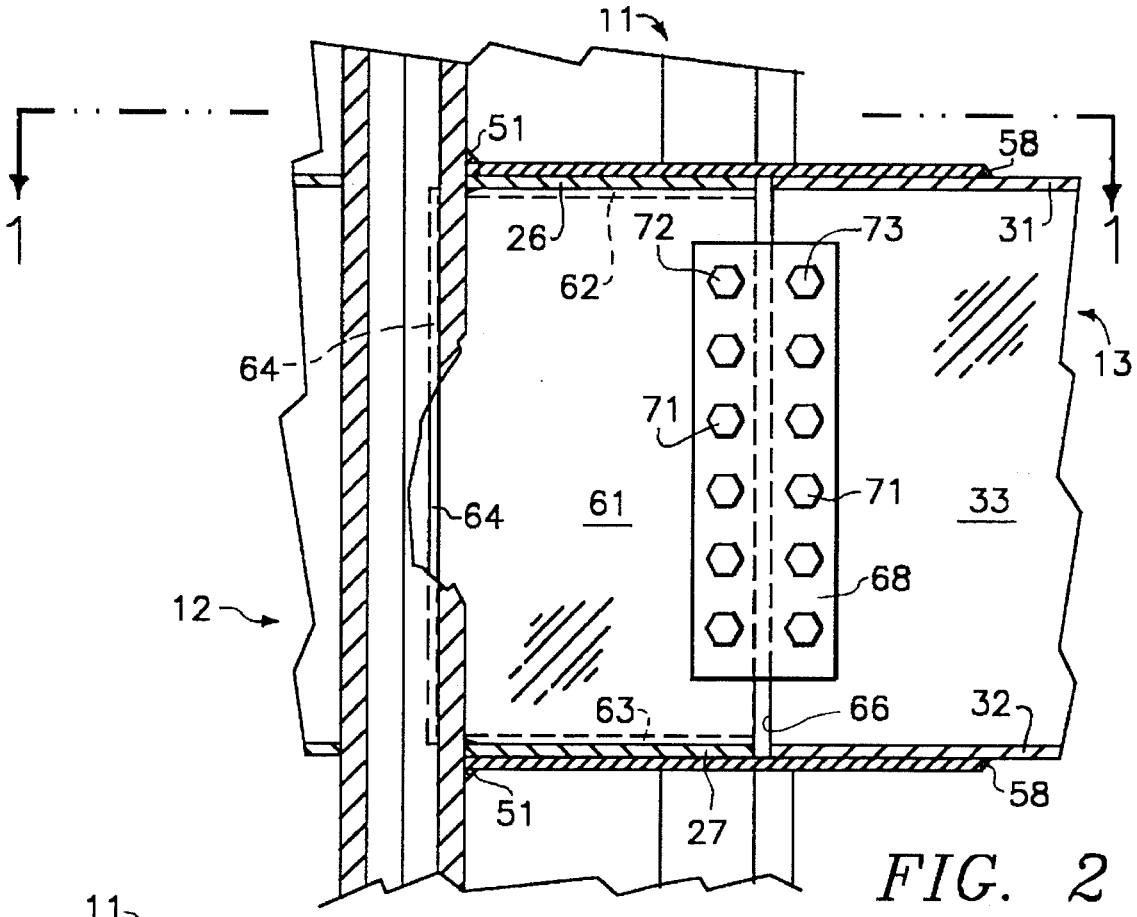
FIG. 2 is a cross sectional view taken along the line 2—2 of FIG. 1.
Figure 1:
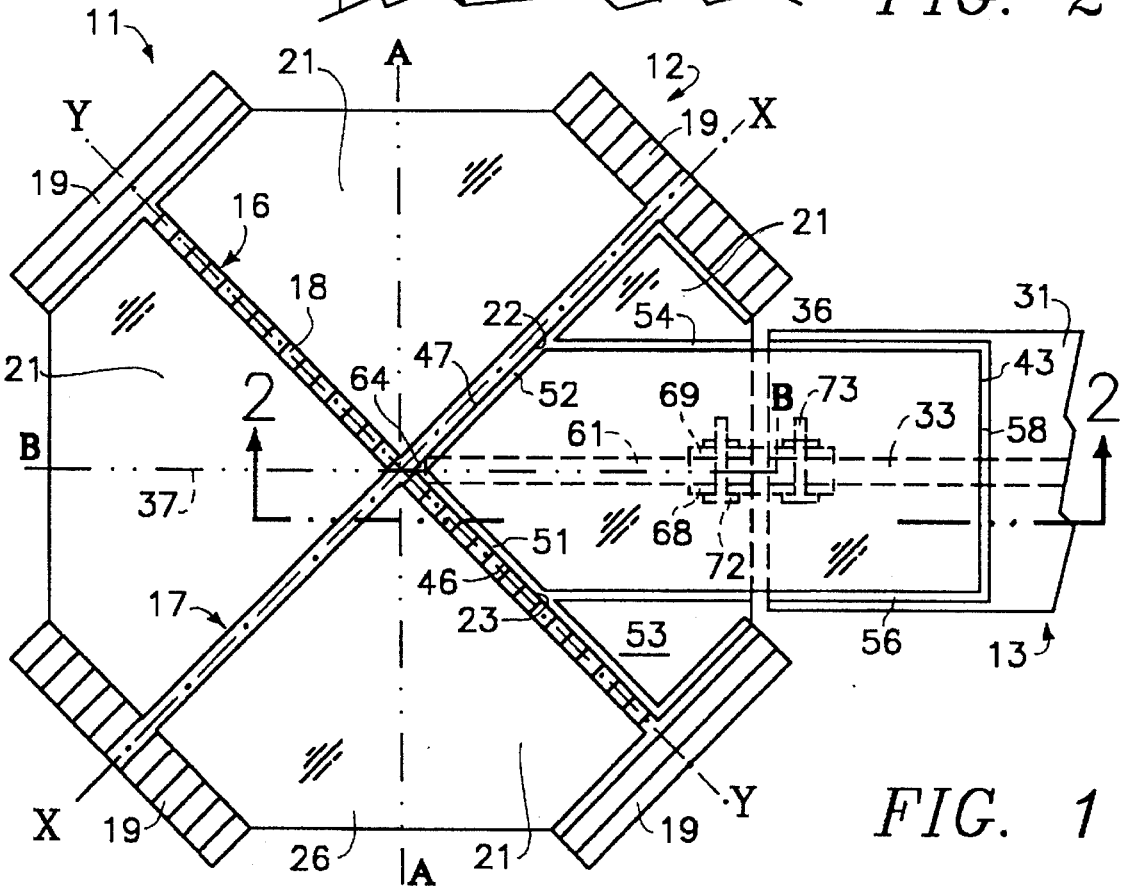
FIG. 1 is a cross sectional view taken along the line 1—1 of FIG. 2 showing a moment resisting frame incorporating the present invention and showing the beam connections utilized.

As shown in FIGS. 1 and 2, the moment resisting frame or structure 11 consists of a plurality of vertical columns 12 and horizontally extending beams 13. The columns 12 as shown in FIG. 1 have a cruciform shape. Typically such cruciform columns are made of two identical steel rolled wide flange sections in which one of the wide flange sections is split in the middle into two pieces along this longitudinal axis, these pieces are connected to the other wide flange section (usually by welding) to form the cruciform shape. Thus for example as shown in FIG. 1 there are provided two wide flange sections 16 and 17 which extend at right angles to each other and which are provided with vertically extending webs 18 having flanges 19 on opposite ends thereof. The webs 18 extend at an angle with respect to each other and as shown in FIG. 1 extend at a suitable angle as for example 90° with respect to each other. These webs 18 define X and Y axes as shown in FIG. 1 extending at 90° with respect to each other. Thus, the webs 18 form four quadrants 21 subtending 90° which are defined by surfaces 22 and 23 of the webs 18 of the sections 16 and 17. These spaces or quadrants 21 are bisected by imaginary axes A—A and B—B extending at right angles to each other and extending at angles of 45° with respect to the X and Y axes hereinbefore described.

Upper and lower spaced apart horizontally disposed gusset plates 26 and 27 are disposed in the spaces or quadrants 21 and are secured to the webs 18 and flanges 19 by suitable means such as fillet welds. Although only two spaced apart gusset plates 26 and 27 have been shown, it should be appreciated that additional vertically spaced-apart gusset plates can be provided on the columns 12 in every region in which a beam connection of the type hereinafter described is to be made.

The columns 12 after fabrication are erected upon a suitable foundation (not shown) so they extend upwardly in a vertical direction therefrom. In accordance with the present invention, the cruciform columns are rotated by 45° from the position they normally would be mounted on the foundation for making the beam connections of the present invention as hereinafter described.

The beams 13 utilized in the moment resisting frame 11 of the present invention are of a conventional construction and have parallel spaced apart flanges 31 and 32 with an interconnecting web 33 extending therebetween. The beam 13 is provided with first and second ends in which only the first end 36 is shown. The beam 13 is provided with a longitudinal axis 37 which extends between the first and second ends. The first end 36 of the beam 13 is brought near to one of the spaces or quadrants 21 so that the flanges 31 and 32 are in general alignment with the gusset plates 26 and 27 of the column as shown in FIGS. 1 and 2. In this way, the longitudinal axis 37 is in alignment with the axis B—B and is disposed at an angle of 45° with respect to the X and Y axis. Upper and lower steel plates 41 and 42 are provided. As can be seen particularly in FIG. 1, the plates 41 and 42 are sized so they have a width which is slightly less than the width of the flanges 31 and 32 of the beam 13. The plates 41 and 42 have a length so they overlap substantial portions of the flanges 31 and 32 and the gusset plates 26 and 27. As shown, the plates 41 and 42 can be provided with an end 43 which extends at right angles to the flanges 31 and 32 and angled ends 46 and 47 which form a suitable angle as for example 90° with respect to each other and which fit within the spaces or quadrants 21 and engage the surfaces 22 and 23 so that fillet welds 51 and 52 can be provided to secure the ends 46 and 47 to the surfaces 22 and 23. Fillet welds 53 and 54 provided for securing the sides of the plates 41 and 42 to the gusset plates 26 and 27. Similarly, fillet welds 56, 57 and 58 are provided for securing the side edges of the upper and lower plates 41 and 42 to the flanges 31 and 32 to the beam 13.

A vertical web connecting plate 61 is provided extends in a plane which is generally in line with the plane of the web 33 of the beam 13 and is secured to the upper gusset plate 26 by fillet weld 62 to the lower gusset plate 27 by a fillet weld 63 and a fillet weld 64 to the intersecting surfaces 22 and 23.

As shown in FIG. 2, a small vertically extending space 66 is provided between the web 33 of the beam 13 and the vertical web connecting plate 61. Vertical connecting plates 68 and 69 are provided on opposite sides of the vertical connecting plate 61 and the web 33 secured thereto by suitable means. For example, fillet welds (not shown) can be provided or alternatively high strength bolts 71 are spaced apart vertically and are disposed in rows with vertical row 72 extending through the vertical web connecting plate 61 and row 73 extending through the web 33 of the beam 13.

In completing the moment resisting frame 11, additional beams 13 can be secured to the columns 12 as for example by providing a beam 13 in each of the spaces or quadrants 21 and extending outwardly therefrom. Thus for example, in addition to the single beam connection shown in FIGS. 1 and 2, beam connections can be provided in a similar manner in the other three quadrants. Thus, the moment resisting frame 11 can be constructed floor by floor until the desired height for the moment resisting frame has been attained. Thereafter, the building can be completed in a conventional manner.

A moment resisting frame 11 incorporating the present invention when utilized in a structure such as a high-rise building will have greatly improved characteristics with respect to resisting earthquakes particularly with respect to moment resisting frames. As is well known to those skilled in the art, cruciform columns have heretofore been utilized to provide the same moment of inertia in two perpendicular directions. The moment of inertia of the cruciform column 12 about the X—X axis equals the sum of inertias of the wide flange sections 16 and 17 which constitute the column about the axis X—X. The moment of inertia of the section 17 about the axis X—X is designated as Ix. The moment of inertia of the section 18 about axis X—X is designated as Iy. The moment of inertia of the cruciform column 12 is equal to Ix plus Iy. Rotating the cruciform column 12 by 45° in a horizontal plane in relationship to the connecting beams 13 does not change the moment of inertia of the cruciform column about the axis A—A and the axis B—B. The moment of inertia about the axis A—A can be expressed as follows:

$$I\text{column}=Ix\sin^2\alpha+Iy\cos^2\alpha$$

$$I\text{column}=2(Ix\sin^2\alpha+Iy\cos^2\alpha)$$

$$\alpha=45°;\ \sin^2\alpha=\cos^2\alpha=½$$

$$I\text{column}=2(I\times½+Iy½)$$

$$I\text{column}=Ix+Iy$$

This establishes that the moment of inertia does not change by rotating the cruciform column in a horizontal plane by 45°.

From the foregoing, it can be seen that there has been provided a beam connection for use with cruciform columns which greatly increases the strength of the connections between the beams and the columns so that there is no need to rely on butt welds. The connection utilized for connecting the beam to the cruciform columns and the method therein should increase the strength of such connections.

I claim:

1. A moment resisting frame comprising a vertical column having a cruciform shape in cross section and having first and second vertically extending surfaces extending at an angle being disposed at an angle with respect to each other and extending along X and Y axes and defining a space therebetween, upper and lower spaced apart horizontally disposed gusset plates, securing means securing said upper and lower spaced apart horizontally disposed gusset plates to said first and second surfaces, a beam having first and second ends and a longitudinal axis, said beam having upper and lower flanges and a vertically extending web extending between the flanges, said first end of the beam extending into a position adjacent said space and in a direction which is disposed between said X and Y axes and means disposed in said space for securing said first end of the beam to said surfaces and to said upper and lower gussets, said connecting means including a connecting plate overlying the upper gusset plate and a connecting plate underlying the lower gusset plate and extending over the flanges of the beam and fillet welds securing the connecting plates to the gusset plates and to the flanges of the beam.

2. A moment resisting frame comprising a vertical column having a cruciform shape in cross section and having first and second vertically extending surfaces extending at an angle and being disposed at an angle with respect to each other and extending along X and Y axes and defining a space therebetween, upper and lower spaced apart horizontally disposed gusset plates, securing means securing said upper and lower spaced-apart horizontally disposed gusset plates to said first and second surfaces, a beam having first and second ends and a longitudinal axis, said beam having upper and lower flanges and a vertically extending web extending between the flanges, said first end of the beam extending into a position adjacent said space and in a direction which is disposed between said X and Y axes and means disposed in said space foe securing said first end of the beam to said surfaces and to said upper and lower gussets, said securing means including a vertical web of the beam and fillet welds connecting the vertical web connection plate to the gusset plates and to the column.

3. A frame as in claim 2 together with vertical connecting plates disposed on opposite sides of the vertical web connecting plate and the web of the beam and means connecting the vertical connecting plate to the vertical web connecting plate and to the web of the beam.

4. A frame as in claim 3 wherein said means connecting the vertical connecting plate to the vertical web connecting plate and to the web of the beam includes a plurality of high strength bolts.

5. A frame as in claim 2 wherein said space is in the form of a quadrant.

6. A frame as in claim 2 wherein said X and Y axes are disposed at approximately 90° with respect to each other.

7. In a method for constructing a moment resisting frame by the use of vertical columns having a cruciform shape in cross section and having first and second vertically extending surfaces extending at an angle to each other and being disposed along X and Y axes and defining a space therebetween with upper and lower spaced apart horizontally disposed gusset plates secured to the first and second surfaces and by the use of a beam having first and second ends and a longitudinal axis and having upper and lower flanges and a vertically extending web extending between the flanges comprising rotating the cruciform in a direction so that said space with an axis bisecting the space extends in a direction in which the beam is to extend, bringing the first end of the beam into close proximity to the space so that its upper and lower flanges are aligned with the upper and lower gusset plates and securing the first end in the space so that it is secured to the first and second surfaces and to the upper and lower gussets, providing connecting plates overlying and underlying the upper and lower gusset plates and the upper and lower flanges of the beam and forming fillet welds between the connecting plates and the upper and lower flanges of the beam and the upper and lower gusset plates.

8. A method as in claim 7 together with the step of providing vertical connecting plates and connecting the vertical connecting plates to the web of the beam and to a vertical web connecting plate connected to the upper and lower gusset plates.

9. A method as in claim 8 together with providing high strength bolts connecting the vertical connecting plates to the web of the beam and the vertical web connecting plate.

10. A method as in claim 8 wherein the web of the beam is connected to the cruciform column so that the web extends in a direction which bisects the space.

* * * * *